US006292081B1

(12) United States Patent
Armfield et al.

(10) Patent No.: US 6,292,081 B1
(45) Date of Patent: Sep. 18, 2001

(54) TUNABLE SURFACE MOUNT TOROIDAL INDUCTOR

(75) Inventors: James Martin Armfield, Atlanta; Kevin James Frasier, Lawrenceville, both of GA (US)

(73) Assignee: Scientific-Atlanta, Inc., Lawrenceville, GA (US)

( * ) Notice: Subject to any disclaimer, the term of this patent is extended or adjusted under 35 U.S.C. 154(b) by 0 days.

(21) Appl. No.: 09/428,739

(22) Filed: Oct. 28, 1999

(51) Int. Cl.[7] ..... H01F 27/06; H01F 27/29

(52) U.S. Cl. ..... 336/65; 336/229; 336/233; 336/192

(58) Field of Search ..... 336/65, 233, 192, 336/229

(56) References Cited

U.S. PATENT DOCUMENTS 4,967,175 * 10/1990 Berg et al. ..... 336/65
6,033,594 * 3/2000 Enokido et al. ..... 252/62.62

FOREIGN PATENT DOCUMENTS

0060933 * 5/1977 (JP) ..... 336/65
406112046-A * 4/1994 (JP) ..... 336/65

* cited by examiner

*Primary Examiner*—Anh Mai
(74) *Attorney, Agent, or Firm*—Hubert J. Barnhardt III; Kenneth M. Massaroni; Kelly A. Gardner

(57) ABSTRACT

A surface mount, tunable inductor (200) includes a core (205) that is substantially toroidal in shape. The core (205) has a first flattened surface (206) and a second flattened surface (207) opposite the first flattened surface (206), and a hole (208) is formed through the core (205). A wire (210) is wound about the core (205) and terminates in first and second leads (215). The inductor (200) also includes a substrate (220) on which first and second conductive pads (225) are formed. Each of the wire leads (215) is electrically coupled to one of the conductive pads (225), and an adhesive (240) secures the first flattened surface (207) of the core (205) to the substrate (220).

14 Claims, 1 Drawing Sheet

Prior Art 100

TUNABLE SURFACE MOUNT TOROIDAL INDUCTOR

FIELD OF THE INVENTION

This invention relates generally to inductors, and more specifically to toroidal inductors for use in communication electronics.

BACKGROUND OF THE INVENTION

Inductors that are commonly used in communication devices include core material around which one or more wires are coiled to form magnetic fields when current is applied. Typically, an inductor includes a core about which a wire is wound, and the wire terminates in two leads. The leads are inserted through holes in a printed circuit board to mount the inductor into a communication device. Leaded components, however, are undesirable in large volume manufacturing applications because each component must be manually disentangled from other components and pulled from a bin by a human operator. The component leads must then be manually straightened, adjusted at the correct distance from one another, and then threaded into the printed circuit board holes. Additionally, the component leads must be bent to secure the component during a wave soldering process, and excess wire must be trimmed from the leads. It can be seen that this process is time consuming and that over-handling and bending of the leads can result in breakage or deformation. Furthermore, if the wire leads are not stripped to the correct length, even proper assembly can result in poor mechanical and electrical coupling if, for example, the wire insulation extends through the printed circuit board hole to prevent the formation of adequate solder connections.

Alternatively, an inductor can be manufactured as a surface mount device, i.e., one that is mounted directly to the surface of a printed circuit board. To mount the inductor, it is placed on the surface of the board, which is moved through an oven in a solder reflow process. The temperatures of the oven are sufficiently high to liquefy solder placed between the inductor and the printed circuit board, and, once the board has cooled, the solder hardens to provide a mechanical and electrical connection between the inductor and the printed circuit board.

Some chip-type surface mount inductors are rectangular in shape. The wire surrounding the core is usually encapsulated in a plastic or other non-conductive material, and electrically conductive terminals at each end of the rectangular device are exposed for connection to a printed circuit board. Due to the rectangular shape, however, the magnetic field radiates outward, worsening the Q of the device and permitting flux leakage.

Toroidal inductors can be used to contain the magnetic field within the core, thereby preventing flux leakage and providing a better Q. One such device 100 is depicted in FIG. 1. As shown, the core 105 is toroidal, and a wire 110 is wound around the core 105. The wire 110 terminates in leads 115 that can be inserted into a printed circuit board for mounting.

Toroidal surface mount inductors can also be formed. These inductors are typically packaged in a non-conductive encapsulant material or housing. Electrically conductive device terminations are then provided on the exterior of the housing so that the device can be reflowed to a printed circuit board. Although the mounting process is simplified in this way, use of such an inductor can cause performance problems because the wire coils are not accessible for tuning. As a result, conventional surface mount toroidal inductors are only practical for use in devices in which a broad range of tolerances is acceptable. An additional consideration is that horizontally packaged toroidal inductors consume a large amount of space on a printed circuit board, and space considerations are of the utmost importance in consumer electronics, portable devices, and many other communication devices. Vertically mounted surface mount toroidal inductors, on the other hand, may lack mechanical integrity and can therefore be unreliable in portable devices or devices subject to vibration, temperature extremes, and other environmental conditions.

Thus, what is needed is a surface mount toroidal inductor that can be tuned for use in communication devices.

DETAILED DESCRIPTION OF A PREFERRED EMBODIMENT

As mentioned briefly in the Background of the Invention hereof, conventional surface mount chip inductors are generally not tunable and do not perform as well as toroidal inductors. Although toroidal inductors can be surface-mounted, existing surface mount toroidal inductors also cannot be tuned. Furthermore, such toroidal inductors often require a relatively large amount of space for mounting, or the mechanical bonds between the inductor and a printed circuit board may lack strength due to a vertical orientation of the toroidal core.

The surface mount toroidal inductor of the present invention solves the problems presented by conventional devices. More specifically, the inductor of the present invention is characterized by a relatively high Q and low flux leakage. It is also tunable, reliable, and can be surface mounted.

Figure 1:
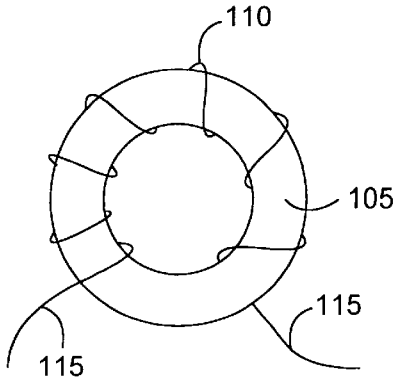
FIG. 1 is a front view of a conventional toroidal inductor.
Figure 2:
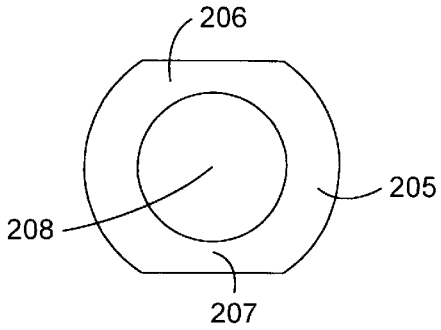
FIG. 2 shows a substantially toroidal core in accordance with the present invention.

FIG. 2 shows a core 205 for a toroidal inductor. According to the present invention, the core 205 is substantially toroidal in shape. However, the toroid 205 is flattened in two locations to form substantially planar opposing surfaces 206 and 207, which are coupled by the curves surfaces typically associated with a toroid. A hole 208 is formed through the core 205 to complete the substantially toroidal shape of the core 205. The core 205 may be formed from ferrite or another magnetic material, and it can be manufactured as a molded part.

Figure 3:
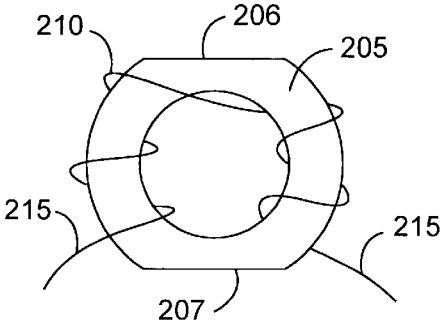
FIG. 3 shows the core of FIG. 2 after winding with a wire in accordance with the present invention.

Once the core 205 has been formed, a wire 210 (FIG. 3) is wound through the hole 208 and about the core 205. Preferably, the winding is adjusted so that no portion of the wire 210 crosses the flattened top surface 206 or the flattened bottom surface 207. The wire 210 terminates in two leads 215.

Figure 4:
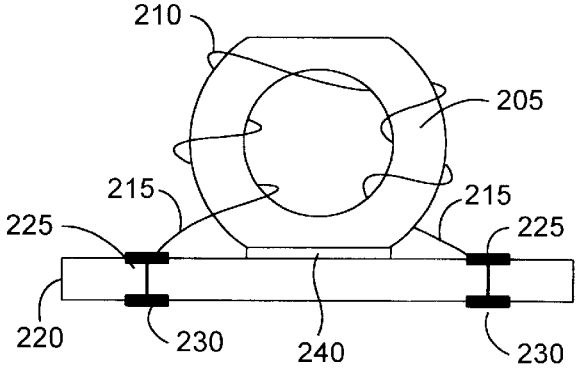
FIG. 4 is a front view of a tunable, toroidal inductor, which includes the core and winding of FIGS. 2 and 3 in accordance with the present invention.

Referring next to FIG. 4, the bottom flattened surface 207 is secured to a relatively small substrate 220, or interposer. This can be done, for instance, through use of a nonconductive adhesive 240, which lends mechanical strength not present in prior art vertically mounted toroidal inductors. Next, the leads 215 are electrically coupled to conductive contacts 225 formed on the upper surface of the substrate 220. For most surface mount applications, conductive contacts 230 formed on the lower surface of the substrate 220, opposite the upper surface, correspond to and are coupled to the upper contacts 225, respectively. Each upper contact 225 can, for example, be electrically coupled to its corresponding lower contact 230 by a plated via hole formed through the substrate 220 or by metallization deposited at the edge of the substrate 220 and on both surfaces between the upper contact 225 and its corresponding lower contact 230. In this manner, a surface mount toroidal inductor 200 can be manufactured in accordance with the present invention.

The inductor 200 not only contains the magnetic field within the core 205, but also is reliably secured to its substrate 220 for greater mechanical integrity despite its vertical orientation. More specifically, since the core 205 itself, rather than merely the wire leads 215, is mechanically secured to the substrate 220, the wire leads 215 are not subjected to stress, such as movement and bending, that could result in breakage or disconnection of the leads 215 from the contracts 225. Furthermore, because the wire 210 and core 205 are not encapsulated or packaged into a housing and because the wire 210 is wound about the curved surfaces of the core 205, the inductor 200 can be easily tuned at any time simply by pushing the wire coils closer together or farther apart. As a result, the inductor 200 is suitable even for low tolerance applications.

Figure 5:
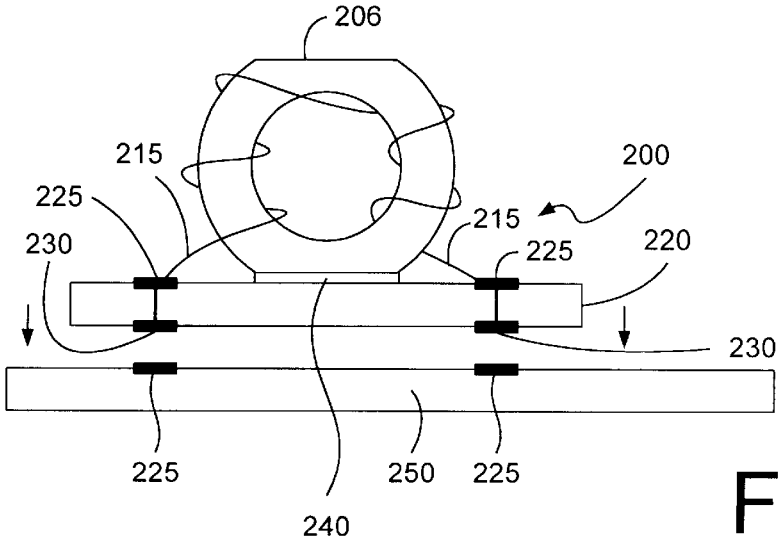
FIG. 5 depicts the mounting of the inductor of FIG. 4 to a separate substrate in accordance with the present invention.

FIG. 5 depicts the use of the surface mount, tunable toroidal inductor 200 in a communication device, such as an amplifier, transmitter, receiver, node, etc., that includes a substrate 250 on which other electronic devices (not shown) are mounted. The substrate 250 can be, for instance, a printed circuit board or a flexible substrate having electrically conductive traces printed thereon for conducting electrical signals. The inductor 200 receives and transmits electrical signals to other circuitry of the substrate 250 via conductive terminals 255 formed on the surface of the substrate 250.

The inductor 200 is mounted to the substrate 250 in a conventional reflow process. More specifically, a solder paste can be applied to terminals 255, after which the inductor is placed on the substrate 250 in alignment with the terminals 255, and the substrate 250 is subjected to temperatures sufficiently high to liquefy the solder. It will be appreciated that the solder used to bond contacts 230 to terminals 255 should liquefy at a temperature lower than that required to liquefy the solder that bonds the wire leads 215 to contacts 225 so that the reflow process does not disconnect the leads 215 from contacts 225.

Another advantage of the inductor 200 of the present invention is that the flattened upper surface 206 of the toroidal core 205 permits the use of conventional pick-and-place automation to mount the inductor 200 to the substrate 250. For example, pick-and-place equipment that employs a small suction device can grasp and move the inductor 200 by suctioning to the flattened surface 206. Automated mass production can therefore be facilitated by tape-and-reel packaging of a large number of inductors. Conversely, completely circular or elliptical prior art toroidal inductors cannot be easily separated from other components, grasped, or placed by typical assembly equipment, which makes them impractical for large scale manufacturing.

What is claimed is:

1. An inductor, comprising:

a core that is substantially toroidal in shape, the core having a first flattened surface and a second flattened surface opposite the first flattened surface, the core further having a hole formed therethrough;

a wire wound about the core and terminating in first and second leads;

a substrate having first and second contacts formed on an upper surface thereof; and an adhesive for securing the first flattened surface of the core to the upper surface of the substrate, wherein the first and second leads are electrically coupled to the first and second contacts.

2. The inductor of claim 1, wherein the substrate further comprises third and fourth contacts that are electrically coupled, respectively, to the first and second contacts for coupling to an external device.

3. The inductor of claim 2, wherein the third and fourth contacts are formed on a lower surface of the substrate opposite the upper surface.

4. The inductor of claim 3, wherein the wire is accessible and can be moved about the core.

5. The inductor of claim 4, wherein the core is formed of ferrite.

6. The inductor of claim 5, wherein the wire is electrically conductive.

7. The inductor of claim 6, wherein the first and second contacts are coupled, respectively, to the third and fourth contacts metallization deposited on the substrate.

8. An electronic device, comprising:

a device substrate having terminals formed thereon; and an inductor that is tunable and that is surface mount to the device substrate, the inductor comprising:

a core that is substantially toroidal in shape, the core having a first flattened surface and a second flattened surface opposite the first flattened surface, the core further having a hole formed therethrough;

a wire wound about the core and terminating in first and second leads;

an inductor substrate having first and second contacts formed on an upper surface thereof and each coupled to one of the wire leads, and having third and fourth contacts formed on a lower surface thereof and coupled, respectively, to the first and second contacts; and an adhesive for securing the first flattened surface of the core to the upper surface of the inductor substrate, wherein each of the third and fourth contacts is coupled to one of the terminals formed on the inductor substrate.

9. The electronic device of claim 8, wherein the wire of the inductor is accessible and can be moved about the core.

10. The electronic device of claim 9, wherein the core of the inductor is formed of ferrite.

11. The electronic device of claim 10, wherein the wire of the inductor is electrically conductive.

12. The electronic device of claim 11, wherein the first and second contacts are coupled, respectively, to the third and fourth contacts by metallization deposited on the inductor substrate.

13. The electronic device of claim 12, wherein the wire leads are soldered to the first and second contacts.

14. The electronic device of claim 13, wherein the third and fourth contacts are soldered to the terminals.

* * * * *